US005537791A

United States Patent [19]

Champagne

[11] Patent Number: 5,537,791

[45] Date of Patent: Jul. 23, 1996

[54] TRIM CLIP FOR SIDING

[75] Inventor: Wendel J. Champagne, Tomball, Tex.

[73] Assignee: Tommy W. Hollis, Conroe, Tex.

[21] Appl. No.: 285,319

[22] Filed: Jul. 3, 1994

[51] Int. Cl.[6] ..... E04D 1/34

[52] U.S. Cl. ..... 52/520; 52/543; 52/548; 52/489.1; 52/716.8; 52/745.21

[58] Field of Search ..... 52/520, 522, 543, 52/545, 548, 530–552, 704, 712, 716.7, 716.8, 717.01, 718.03, 218.04, 478, 489.1, 489.2, 127.1, 94, 745.21, 747, 748, 512, 288.1, 204.7, 285.3

[56] References Cited

U.S. PATENT DOCUMENTS

| | | | |
|---|---|---|---|
| 1,813,798 | 7/1931 | Gerosa | 52/548 |
| 3,512,222 | 5/1970 | Tinnerman | 52/520 X |
| 3,738,076 | 6/1973 | Kessler | 52/547 |
| 3,824,756 | 7/1974 | Kessler | 52/548 |
| 4,424,655 | 1/1984 | Trostle | 52/520 |
| 4,854,101 | 8/1989 | Champagne . | |
| 4,947,609 | 8/1990 | Champagne | 52/520 X |
| 5,339,608 | 8/1994 | Hollis et al. | 52/545 |

FOREIGN PATENT DOCUMENTS

| | | | |
|---|---|---|---|
| 0642291 | 4/1964 | Belgium | 52/547 |
| 2741703 | 3/1978 | Germany | 52/522 |

*Primary Examiner*—Carl D. Friedman
*Assistant Examiner*—Robert J. Canfield
*Attorney, Agent, or Firm*—John R. Casperson

[57] ABSTRACT

There is disclosed a mounting clip for siding. The clip has a first face and a second face. The clip is formed from a continuous metal strip having a first generally straight portion, a first U-bend portion, and a second U-bend portion. Each portion has a first face and a second face which correspond to the first face and the second face of the clip. Each portion has a first end and a second end. The second end of the first generally straight portion is attached to the first end of the first U-bend portion. The first U-bend portion bends toward the first face of the strip. The first end of the second U-bend portion is attached to the second end of the first U-bend portion. The second end of the second U-bend portion is positioned between the first end of the first U-bend portion and the first face of the first generally straight portion. The second U-bend portion forms an angle in the range of from about 120 degrees to about 150 degrees with respect to the first U-bend portion. The second end of the second U-bend portion forms at least one point which is oriented toward the first U-bend portion. The configuration is easy to insert into a trim strip by hand, and requires no special tools. When the clip is provided with at least one barb protruding from the first face of the first generally straight portion and pointing toward the second U-bend portion it provides more reliable attachment to the topout panel. Where each U-bend portion has a pair of legs which are positioned in generally parallel planes, application of the clip is eased. By providing the clip with a second generally straight portion having a first end and a second end and a bent portion connecting the first generally straight portion with the second generally straight portion said bent portion bending away from the first face of the first generally straight portion; wherein the second generally straight portion forms an angle in the range of from about 20 degrees to about 60 degrees with respect to the first generally straight portion the clip may be used to reliably position the topout panel in a trim strip have a relatively wide groove, due to the biasing action of the second straight portion.

19 Claims, 3 Drawing Sheets

FIG. 1
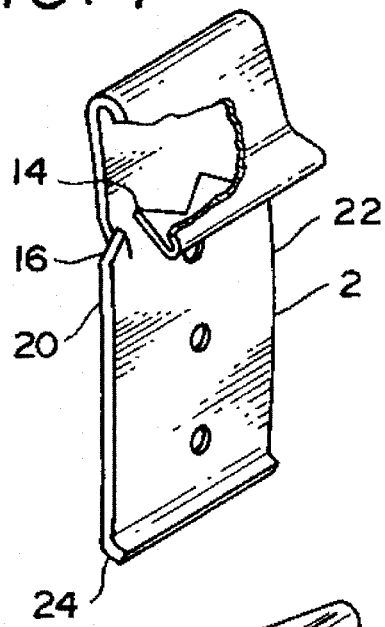
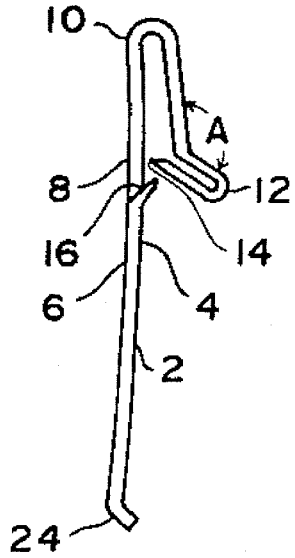
FIG. 2
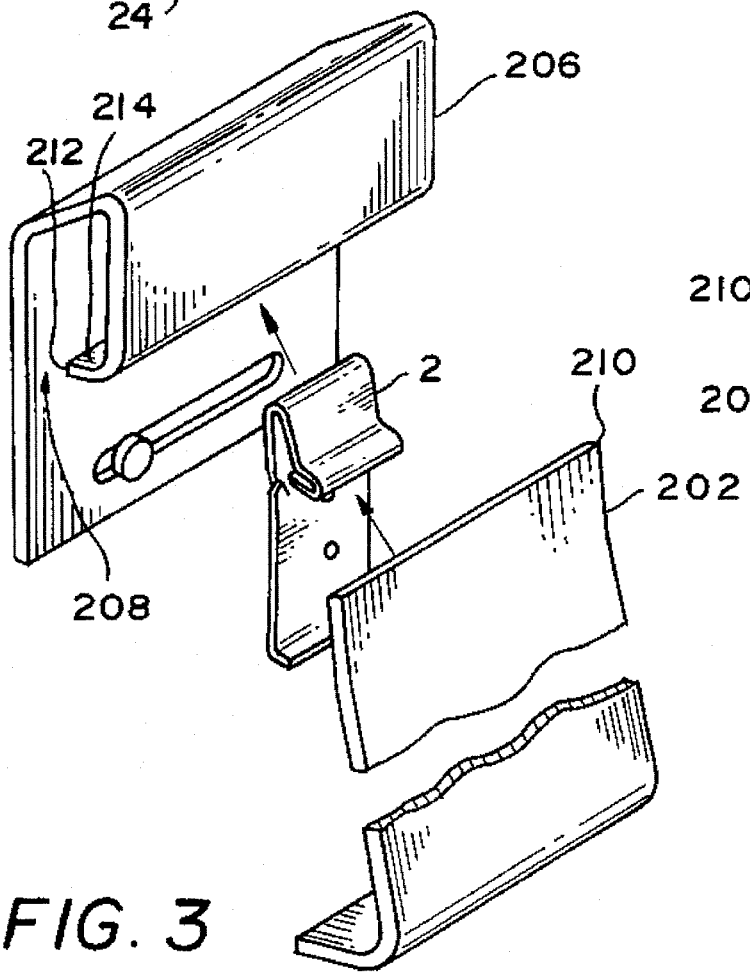
FIG. 3
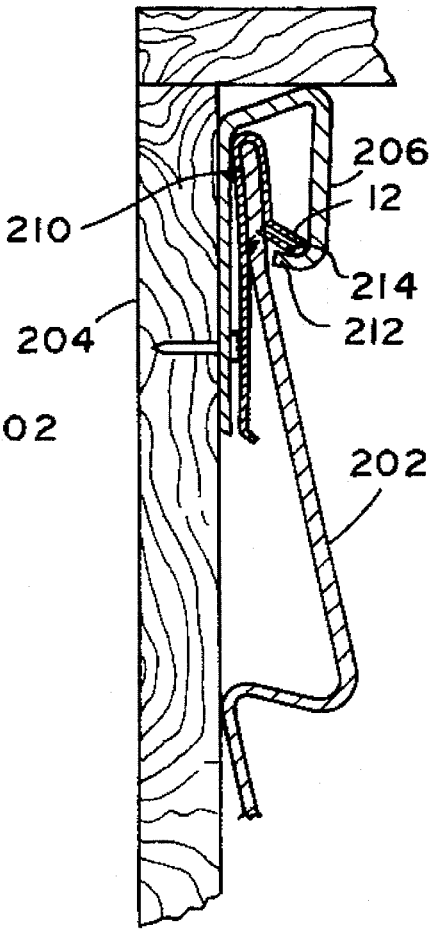
FIG. 4

FIG. 5
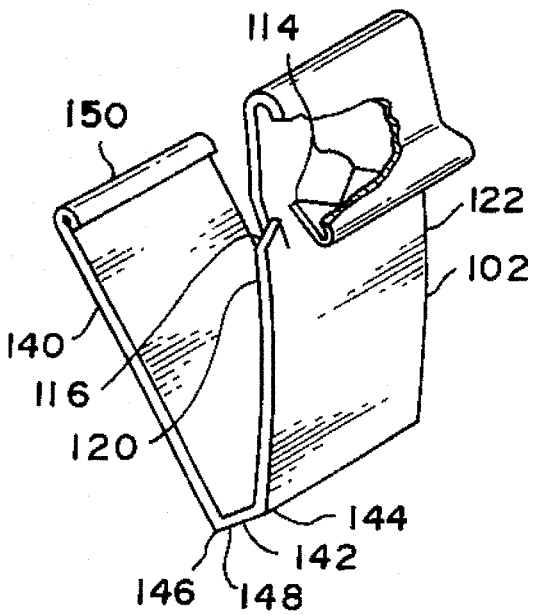
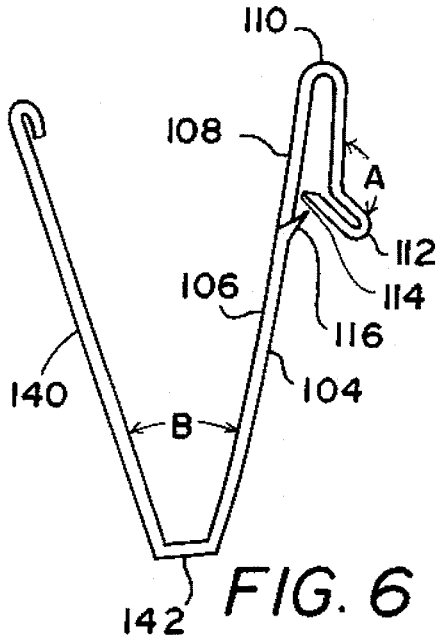
FIG. 6
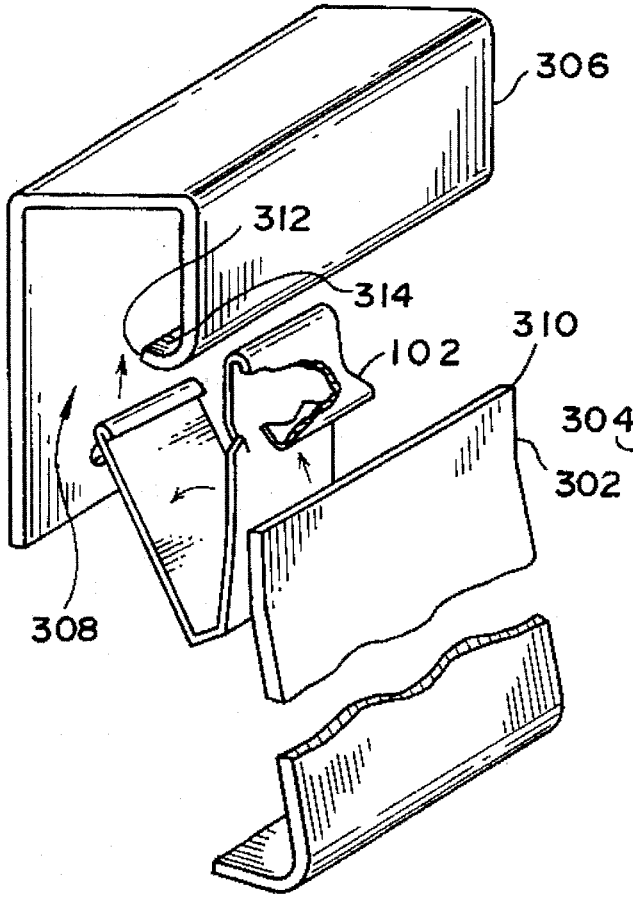
FIG. 7
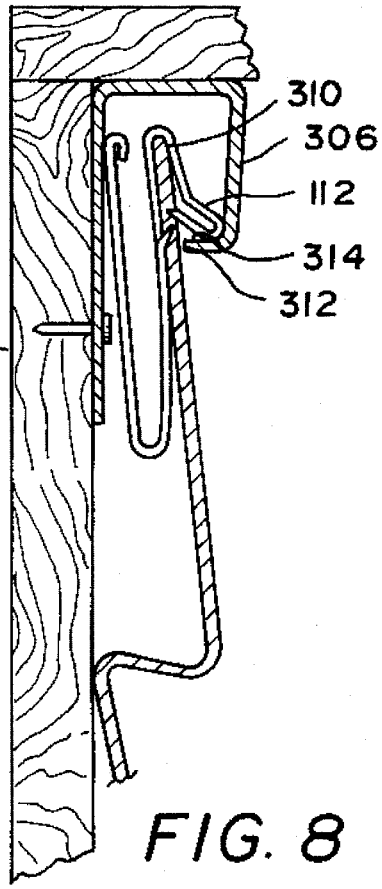
FIG. 8

TRIM CLIP FOR SIDING

BACKGROUND OF THE INVENTION

The invention relates to a clip for mounting siding. In one aspect, the invention relates to a clip that provides good holding power between a siding panel and a trim strip. In another aspect, the invention relates to a method for mounting a siding panel to a trim strip.

The current popular building materials for cladding both commercial and domestic buildings includes siding panels made of metal, such as aluminum, and plastics, such as vinyl. These panels are preformed with profiles simulating at least two rows of clapboard with each panel having top and bottom edges profiled for interlocking with adjacent panels. The panels also have surfaces which may be textured and coated with an almost permanent color finish. The panels are usually started on the building with a starter strip or bracket at the bottom edge of the wall to be covered. The top edge of the panel is secured to the building by inserting it into a trim strip which is an elongated preformed member of the same material as the siding panels and which defines a groove receiving the edge of the panel.

This type of mounting preserves the integrity of the panel, but is not sufficiently secure for all mounting situations. The normal method of improving the security of the mounting is to emboss the edge of the panel with a plurality of spaced apart crimps. These crimps can then be used to grip into the groove of the trim strip to hold the panel in place. While this provides an initial improvement in securing the panel, it is not a permanent fix in that the materials of the panel can relax or flow with time, tending to resume their original shape. Thus an initially tight grip between a panel and the trim may, with time, become sufficiently loose that the panel could be removed by certain weather conditions. U.S. Pat. No. 4,854,101 discloses a crimpable clip that may be used to join panels together. However, this clip requires a special tool and additional time to install.

It would seem that a viable alternative would be to simply nail the top of the panel into the trim strip by driving nails through both the trim and panel. This would undoubtedly secure the member together, but it would also void manufacturers warranties on the panels, be unsightly, and not permit the panels to flex with respect to each other.

A mounting clip that is simple and easy to install and permits some degree of movement between the panels being joined would be very desirable.

OBJECTS OF THE INVENTION

It is an object of this invention to provide a clip for joining siding panels.

It is another object of this invention to provide such a clip that does not require special tools to install.

It is another object of this invention to provide a clip that is especially well adapted to join a topout panel to a trim strip, such as located wall tops and window and door bottoms.

It is another object of this invention to provide a method for mounting a topout panel on a wall being covered by siding.

SUMMARY OF THE INVENTION

In one embodiment of the invention, there is provided a mounting clip for siding. The clip has a first face and a second face. The clip is formed from a continuous metal strip having a first generally straight portion, a first U-bend portion, and a second U-bend portion. Each portion has a first face and a second face which correspond to the first face and the second face of the clip. Each portion has a first end and a second end. The second end of the first generally straight portion is attached to the first end of the first U-bend portion. The first U-bend portion bends toward the first face of the strip. The first end of the second U-bend portion is attached to the second end of the first U-bend portion. The second end of the second U-bend portion is positioned between the first end of the first U-bend portion and the first face of the first generally straight portion. The second U-bend portion forms an angle in the range of from about 120 degrees to about 150 degrees with respect to the first U-bend portion. The second end of the second U-bend portion forms at least one point which is oriented toward the first U-bend portion. The configuration is easy to insert into a trim strip by hand, and requires no special tools.

When the clip is provided with at least one barb protruding from the first face of the first generally straight portion and pointing toward the second U-bend portion it provides more reliable attachment to the topout panel. Where each U-bend portion has a pair of legs which are positioned in generally parallel planes, application of the clip is eased. The clip can be provided with a second generally straight portion having a first end and a second end and a bent portion connecting the first generally straight portion with the second generally straight portion. The bent portion bends away from the first face of the first generally straight portion; wherein the second generally straight portion forms an angle in the range of from about 20 degrees to about 60 degrees with respect to the first generally straight portion. There features enable the clips to be used to reliably position the topout panel in a trim strip having a relatively wide groove, such as a J-trim strip due to the biasing action of the second straight portion.

In another embodiment of the invention, there is provided a method for mounting a topout panel to a wall portion being covered by siding. A next-to top row panel and a trim strip are secured to the wall portion being covered. The trim strip is positioned along an intended terminal edge of the siding panels. The trim strip has a receiving groove for receiving an upper end of the topout panel and an inwardly turned end defining an outer edge of the groove. The inwardly turned edge extends toward the wall portion and forms an upwardly facing shoulder adjacent to the groove. A plurality of trim clips as described above are positioned in the groove of the trim strip. The trim clips are positioned so that the second U-bend portion of each clip contacts the upwardly facing shoulder of the trim strip. The upper end of the topout panel is positioned between the point and the first generally straight portion of each clip. Where each trim clip is provided with a second generally straight portion as defined above, the installation process includes flexing the first generally straight portion of each clip toward the second generally straight portion and inserting each clip into the groove. The flex of the clips is then released so that the topout panel is urged against the inwardly turned end of the trim strip by the flex of the clips.

BRIEF DESCRIPTION OF THE DRAWINGS

FIG. 1 is a pictorial representation of a clip embodying certain features of the present invention and having a portion broken away to show otherwise concealed details.

FIG. 2 is a side view of the clip of FIG. 1.

FIG. 3 is an exploded view illustrating use of the clip of FIG. 1.

FIG. 4 is a sectional view illustrating use of the clip of FIG. 1 to position a topout panel in a trim strip.

FIG. 5 is a pictorial representation of another embodiment of a clip embodying certain features of the present invention and having a portion broken away to show otherwise concealed details.

FIG. 6 is a side view of the clip of FIG. 5.

FIG. 7 is an exploded view illustrating use of the clip of FIG. 5.

FIG. 8 is a side sectional view illustrating use of the clip of FIG. 5 to position a topout panel in a trim strip.

DETAILED DESCRIPTION OF THE PREFERRED EMBODIMENTS

Figure 9:
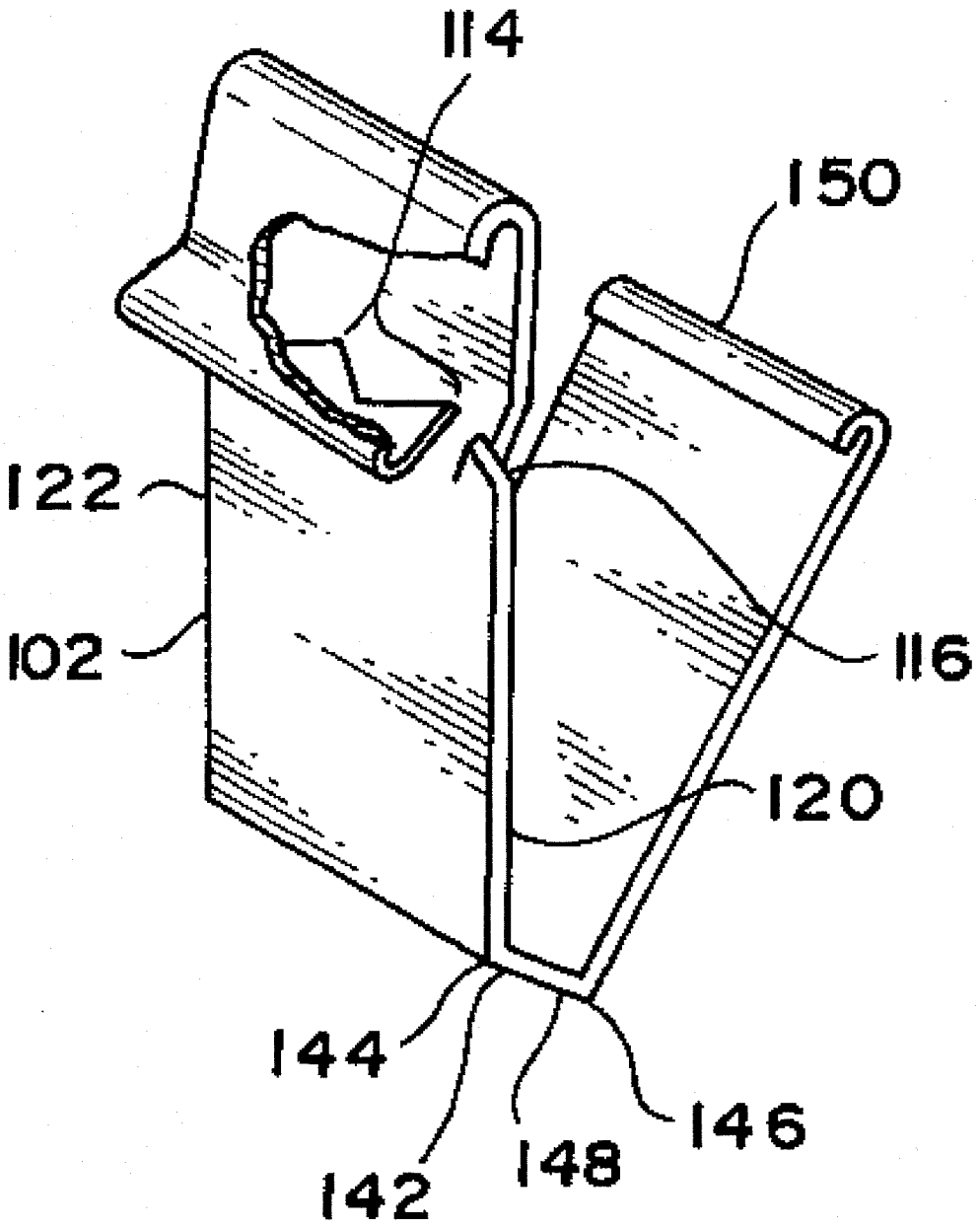
FIG. 9 is a reverse view of the clip shown in FIG. 5.

In one embodiment of the invention, there is provided a mounting clip 2 for siding. The clip has a first face 4 and a second face 6. The clip 2 is formed from a continuous metal strip having a first generally straight portion 8, a first U-bend portion 10, and a second U-bend portion 12. Each portion has a first face and a second face which correspond to the first face and the second face of the clip. Each portion has a first end and a second end. The second end of the first generally straight portion 8 is attached to the first end of the first U-bend portion 10. The first U-bend portion 10 bends toward the first face 4 of the strip. The first end of the second U-bend portion 12 is attached to the second end of the first U-bend portion 10. The second end of the second U-bend portion 12 is positioned between the first end of the first U-bend portion and the first face of the first generally straight portion 8. The second U-bend portion 12 forms an angle in the range of from about 110 degrees to about 160 degrees, preferably in the range of from about 120 degrees to about 150 degrees, with respect to the first U-bend portion 10. The second end of the second U-bend portion 12 forms at least one point 14 which is oriented toward the first U-bend portion 10. It has been found that a clip having this configuration is easy to insert into a trim strip by hand, and requires no special tools.

In a preferred embodiment, the clip 2 further comprises at least one barb 16 protruding from the first face of the first generally straight portion 8. The barb 16 points toward the first U-bend portion 10. The U-bend portions preferably each have a pair of legs which are positioned in generally parallel planes.

For greater holding power, it is preferred that the at least one barb comprises a first triangular barb positioned adjacent to a first side edge 20 of the first generally straight portion 8 and a second triangular barb positioned adjacent to a second side edge 22 of the first generally straight portion 8. It is also preferred that the least one point 14 comprises at least two points, more preferably, three. The clip is preferably formed by a stamping and folding process. The barbs are thus preferably formed from a portion of the strip. For best results, the barbs should be oriented at an angle in the range of from about 30 degrees to about 60 degrees with respect to the first face of the first generally straight portion 8. The at least one point 14 is preferably positioned adjacent to the first generally straight portion 8.

For ease of application, it is preferred that the clip be provided with a short bent portion 24 positioned at the first end of the first generally straight portion 8. The short bent portion 24 generally forms an angle A with the first generally straight portion 8 which is in the range of from about 30 degrees to about 60 degrees. The short bent portion is preferably bent toward the first face of the first generally straight portion. A roll could be used instead of a bent portion if desired.

In another embodiment of the invention, there is provided a mounting clip 102 for siding. The clip has a first face 104 and a second face 106. The clip 102 is formed from a continuous metal strip having a first generally straight portion 108, a first U-bend portion 110, and a second U-bend portion 112. Each portion has a first face and a second face which correspond to the first face and the second face of the clip. Each portion has a first end and a second end. The second end of the first generally straight portion 108 is attached to the first end of the first U-bend portion 110. The first U-bend portion 110 bends toward the first face 104 of the strip. The first end of the second U-bend portion 112 is attached to the second end of the first U-bend portion 110. The second end of the second U-bend portion 112 is positioned between the first end of the first U-bend portion and the first face of the first generally straight portion 108. The second U-bend portion 112 forms an angle A in the range of from about 110 degrees to about 160 degrees, preferably in the range of from about 120 degrees to about 150 degrees, with respect to the first U-bend portion 110. The second end of the second U-bend portion 112 forms at least one point 114 which is oriented toward the first U-bend portion 110.

In a preferred embodiment, the clip 102 further comprises at least one barb 116 protruding from the first face of the first generally straight portion 108. The barb 116 points toward the first U-bend portion 110. The U-bend portions preferably each have a pair of legs which are positioned in generally parallel planes.

For greater holding power, it is preferred that the at least one barb 116 comprises a first triangular barb positioned adjacent to a first side edge 120 of the first generally straight portion 108 and a second triangular barb positioned adjacent to a second side edge 122 of the first generally straight portion 108. It is also preferred that the least one point 114 comprises at least two points, more preferably, three. The clip is preferably formed by a stamping and folding process. The barbs are thus preferably formed from a portion of the strip. For best results, the barbs should be oriented at an angle in the range of from about 30 degrees to about 60 degrees with respect to the first face of the first generally straight portion 108. The at least one point 114 is preferably positioned adjacent to the first generally straight portion 108.

The clip 102 preferably further comprises a second generally straight portion 140 having a first end and a second end and a bent portion 142 connecting the first generally straight portion 108 with the second generally straight portion 140. The bent portion 142 bends away from the first face of the first generally straight portion 108. The second generally straight portion 140 generally forms an angle B in the range of from about 10 degrees to about 70 degrees, preferably between about 20 degrees and about 60 degrees, with respect to the first generally straight portion 108. The clip 102 may be used to reliably position the topout panel in a trim strip having a relatively wide groove, due to the biasing action of the second straight portion. The first generally straight portion 108 and the second generally straight portion 140 each have about the same length.

In the illustrated embodiment, the bent portion 142 has a first bend 144 and a second bend 146. A third generally straight portion 148 extends between the first bend and the second bend. The third generally straight portion 148 forms an angle in the range of from about 100 degrees to about 140 degrees with each of the first generally straight portion 108 and the second generally straight portion 140. The first end of the second generally straight portion 140 is preferably connected to the bent portion 142. The second end of the second generally straight portion 140 preferably has a rolled edge 150 which is rolled away from the first face, although a bent edge could be used if desired.

It is important that the clip have adequate spring strength to perform its function. For vinyl siding, a mounting which is formed from stainless steel spring stock will provide good results. The blank stock can have a length in the range of about 2 inches to about 8 inches, preferably about 3 inches to about 6 inches, and a width in the range of about 0.25 inches to about 3 inches, preferably about 0.5 inches to about 1 inch, and a thickness in the range of from about 0.003 inches to about 0.020 inches, preferably about 0.009 inches to about 0.015 inches.

In another embodiment of the invention, there is provided a method for mounting a topout panel 202 to a wall portion 204 being covered by siding. A next-to top row panel (not shown) and a trim strip 206 are secured to the wall portion being covered. The trim strip 206 is positioned along an intended terminal edge of the siding panels. The trim strip has a receiving groove 208 for receiving an upper end 210 of the topout panel and an inwardly turned end 212 defining an outer edge of the groove. The inwardly turned edge extends toward the wall portion 204 and forms an upwardly facing shoulder 214 adjacent to the groove. A plurality of trim clips as described above with reference to FIGS. 1 and 2 are positioned in the groove 208 of the trim strip 206. The trim clips are positioned so that the second U-bend portion 12 of each clip contacts the upwardly facing shoulder 214 of the trim strip. The upper end 210 of the topout panel 202 is positioned between the point 14 and the first generally straight portion 8 of each clip. The trim clips can first positioned either on the topout panel and slid into the groove or they can positioned in the groove and the topout panel slid into the clip.

In another embodiment of the invention, there is provided a method for mounting a topout panel 302 to a wall portion 304 being covered by siding. A next-to top row panel (not shown) and a trim strip 306 are secured to the wall portion being covered. The trim strip 306 is positioned along an intended terminal edge of the siding panels. The trim strip has a receiving groove 308 for receiving an upper end 310 of the topout panel and an inwardly turned end 312 defining an outer edge of the groove. The inwardly turned edge extends toward the wall portion 304 and forms an upwardly facing shoulder 314 adjacent to the groove. A plurality of trim clips as described above with reference to FIGS. 5 and 6 are positioned in the groove 308 of the trim strip 306. The trim clips are positioned so that the second U-bend portion 112 of each clip contacts the upwardly facing shoulder 314 of the trim strip. The upper end 310 of the topout panel 302 is positioned between the at least one point 114 and the first generally straight portion 108 of each clip. The trim clips can first positioned either on the topout panel and slid into the groove or they can positioned in the groove and the topout panel slid into the clip. Preferably, the clips clipped on to the upper end of the topout panel and are flexed by pressing the topout panel against the wall portion being covered. Either way, the clip is installed by flexing the first generally straight portion of each clip toward the second generally straight portion. The clips are then inserted into the groove. The flex of the clips is then released. The clips thus cause the topout panel to be urged against the inward turned end of the trim strip by the flex of the clips.

I claim:

1. A mounting clip for siding comprising a continuous metal strip having a first face, a second face, a first generally straight portion, a first U-bend portion, and a second U-bend portion, each portion having a first face and a second face which correspond to the first face and the second face of the continuous metal strip, wherein the first generally straight portion has a first end and a second end, the first U-bend portion has a first end and a second end, and the second U-bend portion has a first end and a second end, wherein the second end of the first generally straight portion is attached to the first end of the first U-bend portion, the first U-bend portion bending toward the first face of the strip and the first end of the second U-bend portion is attached to the second end of the first U-bend portion and the second end of the second U-bend portion is positioned between the second end of the first U-bend portion and the first face of the first generally straight portion, the second U-bend portion forming an angle in the range of from about 120 degrees to about 150 degrees with respect to the first U-bend portion, the second end of the second U-bend portion forming at least one point which is oriented toward the first U-bend portion said mounting clip further comprising at least one barb protruding from the first face of the first generally straight portion and pointing toward the first U-bend portion, and wherein each U-bend portion has a pair of legs which are positioned in generally parallel planes.

2. A mounting clip as in claim 2 wherein the at least one barb comprises a first triangular barb positioned adjacent to a first side edge of the first generally straight portion and a second triangular barb positioned adjacent to a second side edge of the first generally straight portion and wherein the at least one point comprises at least two points.

3. A mounting clip as in claim 2 wherein each barb is formed from a portion of the strip and is oriented at an angle in the range of from about 30 degrees to about 60 degrees with respect to the first face of the first generally straight portion.

4. A mounting clip as in claim 3 wherein the second end of the second U-bend portion defines three points which are oriented toward the first U-bend portion.

5. A mounting clip as in claim 4 wherein each of the three points is positioned closely adjacent to the generally straight portion.

6. A mounting clip as in claim 5 wherein the first triangular barb and the second triangular barb are oriented toward the three points.

7. A mounting clip as in claim 6 further comprising a short bent portion positioned at the first end of the first straight portion, said short bent portion forming an angle with the first straight portion which is in the range of from about 30 degrees to about 60 degrees, said short bent portion being bent toward the first face of the first straight portion.

8. A mounting clip as in claim 1 further comprising a second generally straight portion having a first end and a second end; and a bent portion connecting the first generally straight portion with the second generally straight portion said bent portion bending away from the first face of the first generally straight portion; wherein the second generally straight portion forms an angle in the range of from about 20 degrees to about 60 degrees with respect to the first generally straight portion.

9. A mounting clip as in claim 8 wherein the first generally straight portion and the second generally straight portion each have about the same length.

10. A mounting clip as in claim 9 wherein the bent portion has a first bend and a second bend and a third generally straight portion between the first bend and the second bend, wherein the third generally straight portion forms an angle in the range of from about 100 degrees to about 140 degrees with each of the first generally straight portion and the second generally straight portion.

11. A mounting clip as in claim 10 wherein the first end of the second generally straight portion is connected to the bent portion and the second end of the second generally straight portion has a rolled edge which is rolled away from the first face.

12. A mounting clip as in claim 1 which is formed from stainless steel spring stock having a length in the range of about 2 inch to about 8 inches and a width in the range of from about 0.25 inches to about 3 inches and a thickness in the range of from about 0.003 inches to about 0.020 inches.

13. A mounting clip as in claim 1 which is formed from stainless steel spring stock having a length in the range of from about 3 inches to about 6 inches and a width in the range of from about 0.5 inches to about 1 inch and a thickness in the range of from about 0.009 inches to about 0.015 inches.

14. A method for mounting a topout panel to a wall portion being covered by siding, said method comprising:

a. securing a next-to top row panel to the wall portion being covered;

b. securing a trim strip to the wall portion along an intended terminal edge of the siding panels, said trim strip having a receiving groove for receiving an upper end of the topout panel and an inwardly turned end defining an outer edge of the groove which extends toward the wall portion and forms an upwardly facing shoulder adjacent to the groove;

c. positioning a plurality of trim clips in the groove of the trim strip, each such trim clip being formed from a continuous metal strip having a first face, a second face, a first generally straight portion, a first U-bend portion, and a second U-bend portion, having each portion a first face and a second face which correspond to the first face and the second face of the strip wherein the first generally straight portion has a first end and a second end, the first U-bend portion has a first end and a second end, and the second U-bend portion has a first end and a second end, wherein the second end of the first generally straight portion is attached to the first end of the first U-bend portion, the first U-bend portion bending toward the first face of the strip and the first end of the second U-bend portion is attached to the second end of the first U-bend portion so that the second end of the second U-bend is positioned between the second end of the first U-bend portion and the first face of the first generally straight portion, the second U-bend portion forming an angle in the range of from about 120 degrees to about 150 degrees with respect to the first U-bend portion, the second end of the second U-bend portion forming at least one point which is oriented toward the first U-bend portion, said trim clip being positioned so that the second U-bend portion contacts the upwardly facing shoulder of the trim strip; and d. positioning the upper end of the topout panel between the point and the first generally straight portion of each clip.

15. A method as in claim 14 further comprising engaging the topout panel on the point of each clip.

16. A method as in claim 15 wherein the mounting clip further comprises at least one barb protruding from the first face of the first generally straight portion of the mounting clip at a position adjacent to the second U-bend portion, said at least one barb pointing toward the second U-bend portion, said method further comprising engaging the topout panel on the at least one barb of each clip.

17. A method as in claim 14 wherein the trim clips are clipped onto the upper end of the topout panel and the upper end of the topout panel having the trim clips clipped thereon is slid into the groove.

18. A method as in claim 14 wherein each mounting clip further comprises a second generally straight portion having a first end and a second end and a bent portion connecting the first generally straight portion with the second generally straight portion, said bent portion bending away from the first face of the first generally straight portion; wherein the second generally straight portion forms an angle in the range of from about 20 degrees to about 60 degrees with respect to the first generally straight portion, said method further comprising flexing the first generally straight portion of each clip toward the second generally straight portion;

inserting each clip into the groove; and releasing the flex of the clips, wherein the topout panel is urged against the inwardly turned end of the trim strip by the flex of the clips.

19. A method as in claim 18 wherein the clips are clipped onto the upper end of the topout panel and are flexed by pressing the topout panel against the wall portion being covered.

* * * * *